United States Patent [19]

Johnson

[11] 4,128,865

[45] Dec. 5, 1978

[54] SHOCK SUPPRESSING RETAINER RING AND GROMMET FOR SEALED BEAM LAMPS

[75] Inventor: Kenneth L. Johnson, Warren, Pa.

[73] Assignee: Betts Machine Company, Warren, Pa.

[21] Appl. No.: 822,528

[22] Filed: Aug. 8, 1977

[51] Int. Cl.[2] ..... F21V 5/04

[52] U.S. Cl. ..... 362/369; 362/306; 362/374

[58] Field of Search ..... 362/306, 365, 369, 374

[56] References Cited

U.S. PATENT DOCUMENTS

| | | | |
|---|---|---|---|
| 2,571,375 | 10/1951 | Morgenstern | 362/374 |
| 2,733,336 | 1/1956 | Clayton | 362/306 |
| 2,762,908 | 9/1956 | Gaither | 362/306 |
| 3,065,340 | 11/1962 | Mead et al. | 362/369 |
| 3,177,356 | 4/1965 | Worden | 362/374 |
| 3,225,189 | 12/1965 | Pendell | 362/369 |
| 3,280,323 | 10/1966 | Pawlowski | 362/369 X |

*Primary Examiner*—Peter A. Nelson
*Attorney, Agent, or Firm*—Ralph Hammar

[57] ABSTRACT

A sealed beam lamp shock suppressing retainer ring grommet for quadruplicating lamp life.

The dual shocking suppression takes place as a result of the ductile rubberlike material and the cantilever load effect of the lamp on the free end of the grommet.

Additional features include weatherproof lamp electrodes, retainer ring and lamp grommet combined as one unit, external ease of changing the sealed beam lamps and a long retainer ring life.

1 Claim, 4 Drawing Figures

SHOCK SUPPRESSING RETAINER RING AND GROMMET FOR SEALED BEAM LAMPS

In the prior art, retainer rings and grommets were made seperately and offered little vibration protection to the lamp filament.

In this invention the retainer ring and grommet are made as a single unit and provide enough shock and vibration protection to the lamp filament to quadruple the lamp life under vibration and in addition provide water proof lamp electrodes, external ease of changing sealed beam lamps and a longer retainer ring life.

Figure 1:
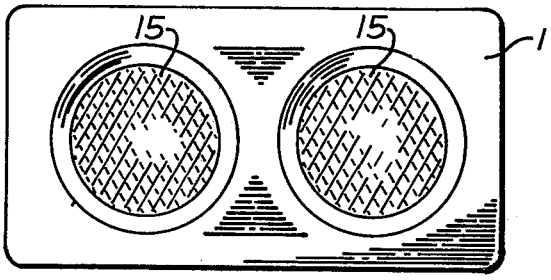
Figure 2:
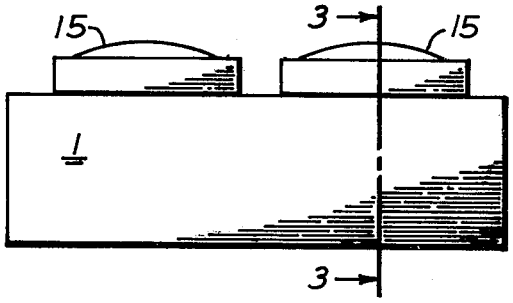
Figure 4:
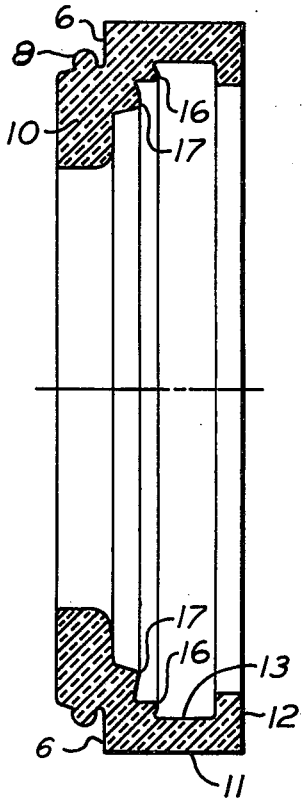
Figure 3:
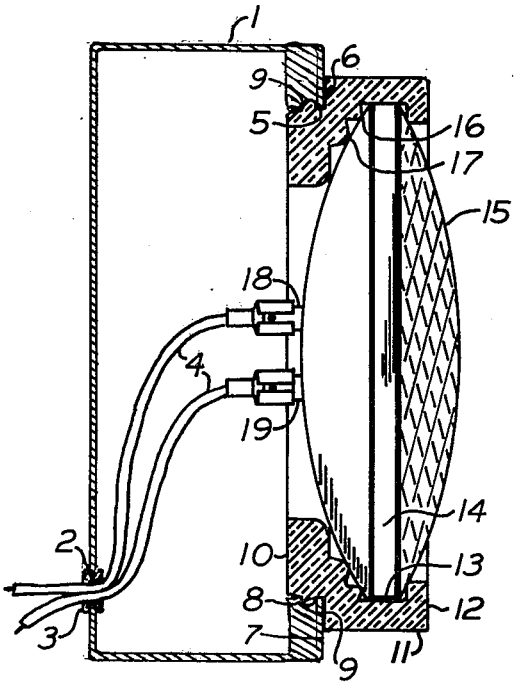

These and other advantages will become apparent as a preferred form of the invention is described in which FIG. 1 is a top plan view of a lamp housing, FIG. 2 is a side elevation, FIG. 3 is a section on line 3—3 of FIG. 2, FIG. 4 is an enlarged sectional view of a combined grommet and retainer ring.

The lamp housing 1 is completely closed except for an opening 2 for a weather proof bushing 3 for lamp leads 4 and openings 5 for each of the lamps. Two lamps are shown which may be used for example. However, any diameter, wattage or candlepower sealed beam/par lamp can be used. Since these lamps are for rough service, and must stand all kinds of weather, it is important that the lamp housing be water proof. It is further important that the lamps be protected from shock and vibration which is particularly severe in truck service or like.

All these objects are achieved by the combined retainer ring and grommet shown in FIG. 4. This unit is molded in one piece of rubber or other suitable elastomeric material. At its inner end the unit has a shoulder 6 seated on the outer sealing surface 7 surrounding the lamp receiving opening 5 and an O ring seal 8 which makes sealing engagement with the inner sealing surface 9. Once installed, there is no need to remove the unit from the opening 5 unless the unit is to be replaced.

Radially inward from the O ring seal 8 is a stiffening flange 10 which mechanically stiffens the inner end of the retaining ring unit. Extending outward from the shoulder 6 is an annular section 11 terminating in an inwardly extending flange 12 at the outer end of a groove 13 which receives the rim 14 of a sealed beam lamp 15. The inner side of the lamp rim rests on beads 16, 17. The outer surface of the lamp rim is gripped by the flange 12. The lamp is removed by peeling the flange 12 locally away from the rim 14 and gradually removing the rim from the groove. The connections 18, 19 to the lamp are made while the lamp is outside the groove.

When the lamp is supported in the groove, it is in overhung or cantilever relation to the lamp housing 1 and is free to move in all directions to cushion shocks and vibrations and thereby prevent damage to the lamp filament. Since most of the shocks and vibrations are in a vertical direction, the cushioning movement is primarily up and down. By reason of the cushioning action, the life of the lamps is increased approximately fourfold. Since the cost of replacing a lamp greatly exceeds the cost of the lamp itself, a fourfold increase in lamp life is an important advantage.

The flange 12 and the associated groove 13 and beads 16 and 17 serve as a grommet for releasably holding the lamp. The seal 8 serves as a retaing ring for holding the lamp in the housing. Normal service such as lamp replacement requires only peeling of the flange 12. The retaining ring need not be removed or disturbed. No special tools are required to install or remove the retainer ring - grommet unit or to remove and replace lamps.

I claim:

1. A retainer ring and grommet for sealed beam/par lamps, comprising a housing having inner and outer sealing surfaces for surrounding a lamp receiving opening, an annular elastomeric body having its inner end received in said opening with the outer end of said body in overhung relation to said sealing surfaces, the inner end of said body having an integral outwardly projecting O-ring and said inner sealing surface having a groove in sealing engagement with said O-ring, a shoulder on said body engaging said outer sealing surface, said sealing surfaces providing substantially the sole support for said body, an internal groove in the outer end of said body spaced outward from said sealing surfaces, a sealed beam lamp having its rim received in supporting relation in said internal groove, the outermost side of said internal groove being peelable away from said rim to permit removal of the lamp, and the section of said body between said sealing surfaces and said internal groove providing a cantilever support for said lamp for cushioning the lamp from shocks and vibrations and thereby increasing lamp life as compared to a solidly mounted lamp.

* * * * *